US005341725A

United States Patent [19]

Dick

[11] Patent Number: 5,341,725

[45] Date of Patent: Aug. 30, 1994

[54] TWIN PISTON POWER CYLINDER

[76] Inventor: James B. Dick, 389 King George Terrace, Victoria, British Columbia, Canada, V8S 2J8

[21] Appl. No.: 76,445

[22] Filed: Jun. 14, 1993

[51] Int. Cl.[5] ..... F01B 15/00

[52] U.S. Cl. ..... 92/66; 92/78; 92/75; 92/117 R; 92/111; 92/151; 92/165 PR; 92/166; 91/216 R; 91/216 A; 91/217

[58] Field of Search ..... 92/66, 75, 117 R, 117 A, 92/118, 110, 111, 151, 150, 165 PR, 166, 78; 91/196, 216 A, 216 B, 216 R, 217

[56] References Cited

U.S. PATENT DOCUMENTS

| | | | |
|---|---|---|---|
| 1,845,797 | 2/1932 | Kearney | 92/166 |
| 2,483,239 | 9/1949 | Sharpe . | |
| 2,832,317 | 4/1958 | Henry | 91/216 A |
| 3,097,572 | 7/1963 | Macy | 92/75 |
| 3,162,365 | 12/1964 | Gizeski . | |
| 3,187,637 | 6/1965 | Edmund . | |
| 3,877,349 | 4/1975 | Schindel | 92/75 |
| 4,526,086 | 7/1985 | Holton et al. | 91/217 |
| 5,111,733 | 5/1992 | Baraniak | 92/66 |

FOREIGN PATENT DOCUMENTS

| | | | |
|---|---|---|---|
| 1219800 | 3/1960 | Fed. Rep. of Germany . | |
| 2255049 | 11/1972 | Fed. Rep. of Germany . | |
| 3826184 | 2/1989 | Fed. Rep. of Germany | 92/75 |
| 2142576 | 2/1973 | France . | |
| 24679 | 2/1977 | Japan | 92/151 |
| 2092229 | 8/1982 | United Kingdom . | |

*Primary Examiner*—Thomas E. Denion

*Attorney, Agent, or Firm*—Oyen Wiggs Green & Mutala

[57] ABSTRACT

A power cylinder (10) has two pistons (12, 20) slidably mounted within separate cylinders (14, 22) to define inner and outer chambers (16, 18; 24, 26) within each cylinder. One or more rods (28) are coupled between the pistons. The outer chambers (18, 26) are coupled together to allow pressurized hydraulic or pneumatic fluid to flow therebetween. The inner chambers (16, 24) are coupled together to allow pressurized hydraulic or pneumatic fluid to flow therebetween. The fluid flow aforesaid may be achieved by using two hollow rods (128, 130) and allowing the fluid to flow through the rods between the respective chambers. A guard (44) may surround first and second cylinders (14, 22). Bearings (46, 48) may be fixed around the opposed inner ends of cylinders (14, 22) to allow slidable displacement of the cylinders relative to guard (44). Seals (146, 148) may be fixed around the opposed inner ends of cylinders (114, 122) to provide a hydraulic chamber (158) enclosed by the guard (144) between the cylinders (114, 122). Where two rods interconnect the dual cylinders, the first piston (212) may be connected to the second cylinder (222) and the first cylinder (214) may be connected to the second piston (220).

12 Claims, 5 Drawing Sheets

TWIN PISTON POWER CYLINDER

FIELD OF THE INVENTION

This application pertains to power cylinders having dual pistons mounted in separate cylinders. The pistons may be coupled together by one or more rods. A guard enclosing the connection between the two cylinders may be provided. The outer chambers of each cylinder may be in fluid communication; and, the inner chambers of each cylinder may be in fluid communication.

BACKGROUND OF THE INVENTION

Conventional power cylinders have a single piston and a single rod. The piston is slidably mounted within a cylinder. The rod is fixed to one end of the piston and protrudes through one end of the cylinder. Pressurized hydraulic or pneumatic fluid is injected into the rod end of the cylinder and withdrawn from the opposite end to force the piston towards the opposite end, thereby retracting the rod within the cylinder. The direction of pressurized fluid flow is reversed to force the piston towards the rod end of the cylinder, thereby extending the rod from the cylinder.

Conventional power cylinders of the foregoing type are subject to a number of disadvantages. For example, the seals used in conventional power cylinders are subject to substantial wear and are generally the components which require maintenance most frequently. In particular, seals which are exposed to the external environment in which the cylinder operates may wear out more quickly. Also, forces imposed on the rod during normal use can bend the rod, accelerating wearing of the seals and/or rod support bearings.

The present invention reduces the wear on each seal, increases the number of seals, and protects the seals from the external environment. For example, seal wear is reduced by providing dual pistons mounted in separate cylinders. This reduces the length of rod travel relative to each seal. Typically, the reduction in travel is on the order of half that of a conventional cylinder.

In conventional power cylinders, an eye is often provided on the end of the rod for attachment to external machinery. This may cause a design problem, in that the rod diameter may have to be increased to provide adequate space for connecting the eye to the rod. Consequently, the rods used in conventional cylinders are sometimes larger and more expensive than is required to support the loads imposed on the cylinder by normal use. The present invention avoids this problem by attaching any necessary eyes to the cylinder rather than to the rod. Rods employed in the present invention therefore do not require an eye. This allows suitable rods to be selected based only on the linear load to be supported by the rod during normal use.

Another disadvantage of conventional cylinders is that a single rod and piston tend to rotate within the cylinder. If several such cylinders are connected in series (to form a robotic manipulator arm, for example) the rotational tendency of each cylinder may affect the stability of the structure and prevent accurate control thereof. Certain embodiments of the invention solve this problem by employing two or more parallel rods. Each rod passes through a separate aperture in the rod end of the cylinder. The rods are thus held in place relative to the cylinder and prevented from rotating as they extend and retract.

In embodiments of the invention having two or more rods, hydraulic fluid may be allowed to pass through the rods between first and second hydraulic cylinders. This simplifies the external hydraulic circuitry required to operate the cylinder and allows the present invention to be directly substituted for conventional cylinders without any alteration of the existing hydraulic circuitry associated with the conventional cylinder.

SUMMARY OF THE INVENTION

In accordance with a first embodiment, the invention provides a power cylinder having a first piston slidably mounted within a first cylinder to define inner and outer chambers within the first cylinder; and, a second piston slidably mounted within a second cylinder to define inner and outer chambers within the second cylinder. A single rod is coupled between the first and second pistons. The two outer chambers are coupled together to allow pressurized hydraulic or pneumatic fluid to flow between the outer chambers. The two inner chambers are coupled together to allow pressurized hydraulic or pneumatic fluid to flow between the inner chambers. A cylindrical guard surrounds the first and second cylinders, with a bearing mechanism being provided to allow slidable displacement of the first and second cylinders relative to the guard. The guard encloses the space between the cylinders through which the rods extend. The rods are thus shielded from the external environment in which the power cylinder operates. This minimizes abrasion or other environmental damage to the rods, thereby prolonging the life of the rod seals.

A second embodiment of the invention is similar to the first embodiment, except that first and second rods are coupled between the first and second pistons.

A third embodiment of the invention is similar to the second embodiment, except that the rods are hollow. This allows pressurized hydraulic or pneumatic fluid to flow through the first rod between the two outer chambers. Similarly, fluid is allowed to flow through the hollow second rod between the two inner chambers. Fluid flow ports are provided in one of the outer chambers and in one of the inner chambers.

In accordance with a fourth embodiment, the invention provides a power cylinder having a first piston slidably mounted within a first cylinder to define inner and outer chambers within the first cylinder, and a second piston slidably mounted within a second cylinder to define inner and outer chambers within the second cylinder. A first hollow rod is coupled between the first piston and the proximal end of the second cylinder. A second rod is coupled between the distal end of first cylinder and the second piston. Along its length, the first hollow rod surrounds the second rod. The two outer chambers are coupled together to allow pressurized fluid to flow between the outer chambers. The two inner chambers are coupled together to allow pressurized hydraulic or pneumatic fluid to flow between the inner chambers. A cylindrical guard may surround the first and second cylinders, with a bearing mechanism for allowing slidable displacement of the first and second cylinders relative to the guard.

Any of the embodiments aforesaid having a cylindrical guard surrounding the first and second cylinders may incorporate a hydraulic input to the guard, with bearing and sealing mechanisms for allowing slidable hydraulic displacement of the first and second cylinders relative to the guard. The guard may also incorporate a filter to inhibit foreign substances from penetrating into the region in which the guard is slidably displaced relative the cylinders, thus minimizing damage to the guard bearings and seals.

DETAILED DESCRIPTION OF THE PREFERRED EMBODIMENT

Figure 1:
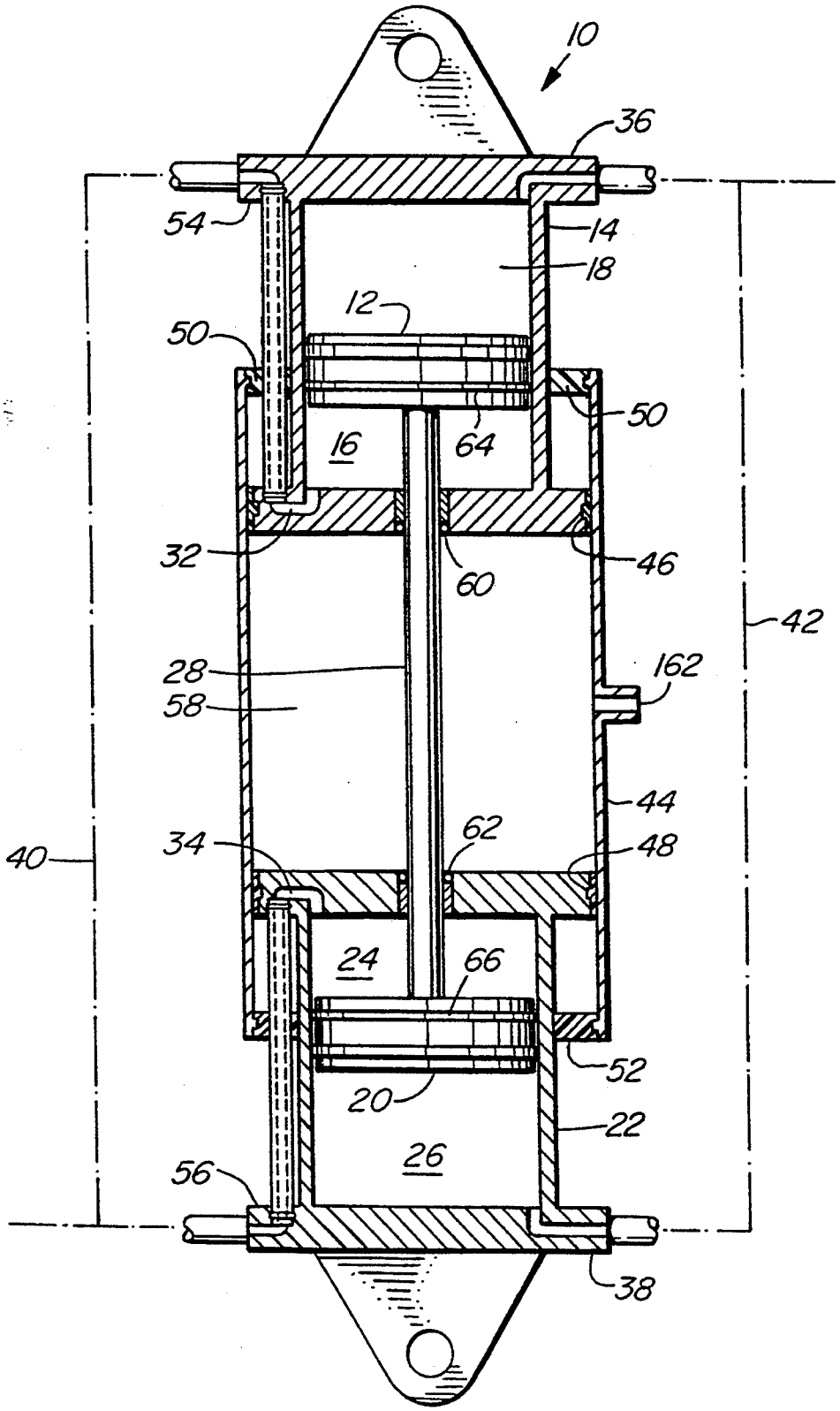
FIG. 1 is a longitudinal cross-sectional illustration of a power cylinder constructed in accordance with the first embodiment of the invention.

FIG. 1 shows a power cylinder 10 having a first piston 12 slidably mounted within a first cylinder 14 to define inner and outer chambers 16, 18 within first cylinder 14. A second piston 20 is slidably mounted within a second cylinder 22 to define inner and outer chambers 24, 26 within second cylinder 22. Rod 28 is coupled between first and second pistons 12, 20 thereby fixing the displacement between the two pistons. Guard 44 surrounds first and second cylinders 14, 22. Bearings 46, 48 are fixed around the opposed inner ends of cylinders 14, 22 to allow slidable displacement of the cylinders relative to guard 44. Additional bearings 50, 52 fixed around the opposed ends of guard 44 serve the same purpose. Stops 54, 56 fixed around the outer ends of cylinders 14, 22 prevent inadvertent dislodgment of guard 44 from around cylinders 14, 22. Guard 44 prevents foreign matter from penetrating into region 58. Foreign matter entering region 58 may nick or abrade rod 28, which may in turn damage rod seals 60, 62 necessitating time consuming, expensive repair operations.

Fluid flow ports 32, 34, 36, 38 are provided in inner chambers 16, 24 and in outer chambers 18, 26 respectively to allow pressurized hydraulic or pneumatic fluid to flow into or out of the chambers. A "fluid flow means" such as conduit 40 is coupled between inner chamber ports 32, 34. Another "fluid flow means" such as conduit 42 is coupled between outer chamber ports 36, 38. Conventional seals 60, 62 are provided in the apertures of cylinders 14, 22 through which rod 28 passes; and, conventional sealing rings 64, 66 are provided around pistons 12, 20.

Cylinder 10 is extended by injecting pressurized hydraulic or pneumatic fluid into conduit 42 while withdrawing fluid from conduit 40. Fluid injected through conduit 42 enters and exerts force on outer chambers 18, 26. Since the pistons are fixed relative to one another, cylinders 14, 22 are slidably forced apart. This increases the volume of outer chambers 18, 26 and simultaneously decreases the volume of inner chambers 16, 24.

Cylinder 10 is retracted by injecting pressurized hydraulic or pneumatic fluid into conduit 40 while withdrawing fluid from conduit 42. Fluid injected through conduit 40 enters and exerts force on inner chambers 16, 24. Since the pistons are fixed relative to one another, cylinders 14, 22 are slidably forced towards one another. This increases the volume of inner chambers 16, 24; simultaneously decreasing the volume of outer chambers 18, 26.

Figure 2:
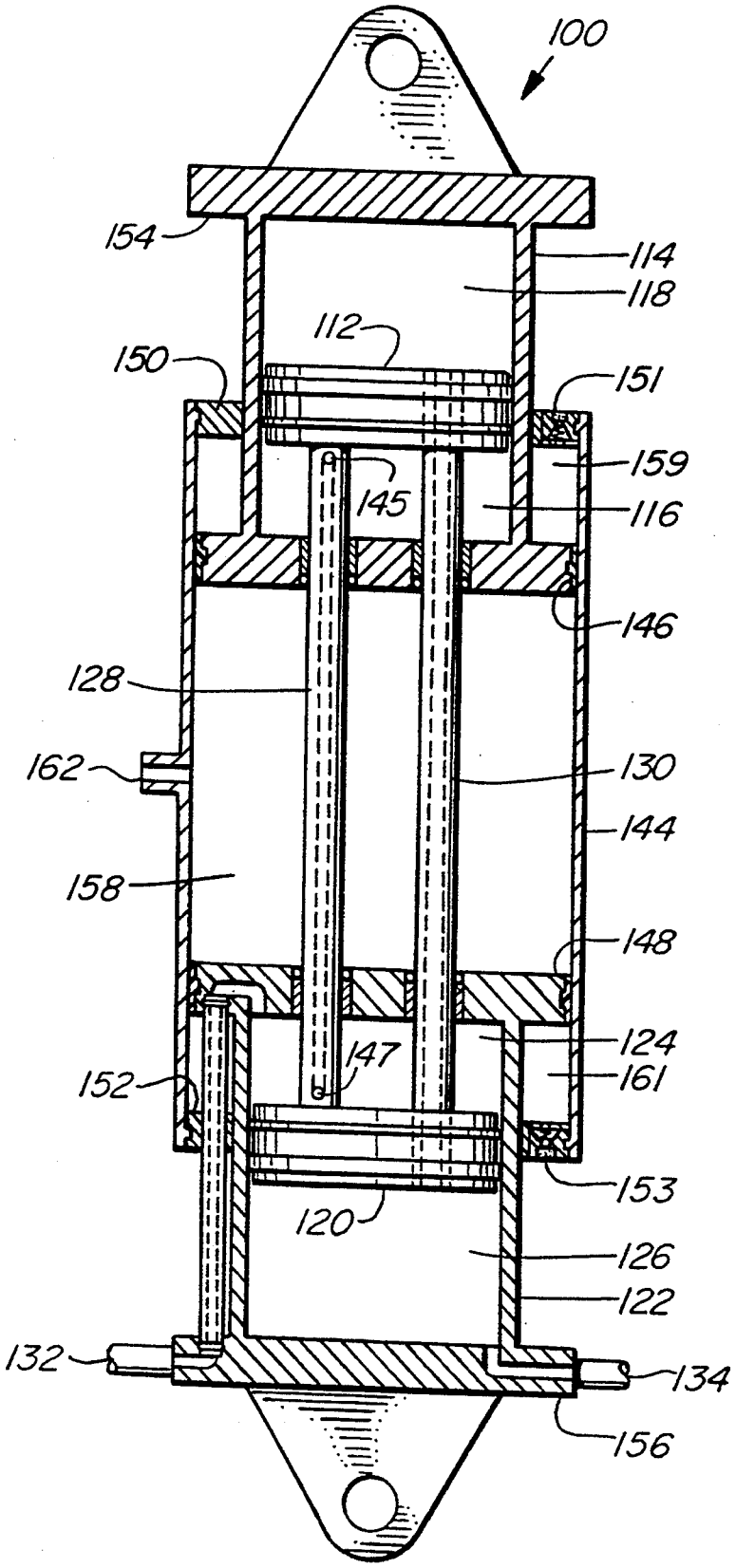
FIG. 2 is a longitudinal cross-sectional illustration of a power cylinder constructed in accordance with the second and third embodiments of the invention.

FIG. 2 illustrates an alternative power cylinder 100 having a first piston 112 slidably mounted within a first cylinder 114 to define inner and outer chambers 116, 118 within first cylinder 114. A second piston 120 is slidably mounted within a second cylinder 122 to define inner and outer chambers 124, 126 within second cylinder 122. Two hollow rods 128, 130 are coupled between first and second pistons 112,120 thereby fixing the displacement between the two pistons. Guard 144 surrounds first and second cylinders 114, 122. Seals 146, 148 are fixed around the opposed inner ends of cylinders 114, 122 to provide a hydraulic chamber 158 enclosed by the guard 144 between the cylinders 114, 122. Bearings 150, 152 fixed around the opposed ends of guard 144 allow slidable displacement of the cylinders relative to guard 144. Stops 154, 156 fixed around the outer ends of cylinders 114, 122 prevent inadvertent dislodgment of guard 144 from around cylinders 114, 122. Filters 151, 153 prevent foreign matter from penetrating into regions 159, 161, thereby protecting seals 146, 148.

Rod 130 passes through pistons 112, 120 (or communicates with apertures which pass through both pistons) to allow pressurized hydraulic or pneumatic fluid to flow through rod 130 between outer chambers 118, 126. Rod 128 is coupled between the inner faces of pistons 112, 120 such that fluid may flow through rod 128 between inner chambers 116, 124 via apertures 145, 147 provided in each end of rod 128 near the inner faces of pistons 112, 120. Fluid inlet/outlet ports 132, 134 are provided in one of the inner chambers and in one of the outer chambers. Conventional seals are provided in the apertures of cylinders 114, 122 through which rods 128, 130 pass. Conventional sealing rings are provided around pistons 112, 120.

Cylinder 100 is extended by injecting pressurized hydraulic or pneumatic fluid into port 134 while withdrawing fluid through port 132. Fluid injected through port 134 enters outer chamber 126 and passes through hollow rod 130 into outer chamber 118. The fluid in the two outer chambers exerts force on pistons 112, 120. Since the pistons are fixed relative to one another, cylinders 114, 122 are slidably forced apart. This increases the volume of outer chambers 118, 126 (allowing additional fluid to be injected into the outer chambers if it is desired to continue extending cylinder 100) and simultaneously decreases the volume of inner chambers 116, 124. As the volume of inner chamber 116 decreases fluid is expelled through hollow rod 128 into inner chamber 124 for ejection through port 132.

Cylinder 100 is retracted by injecting pressurized hydraulic or pneumatic fluid into port 132 while withdrawing fluid through port 134. Fluid injected through port 132 enters inner chamber 124 and passes through rod 128 into inner chamber 116. Fluid within the two inner chambers exerts force on the inner chambers 116, 124. Since the pistons are fixed relative to one another, cylinders 114, 122 are slidably forced towards one another. This increases the volume of inner chambers 116, 124 (allowing additional fluid to be injected into the inner chambers if it is desired to continue retracting cylinder 100) and simultaneously decreases the volume of outer chambers 118, 126. As the volume of outer chamber 118 decreases, fluid is expelled through hollow rod 130 into outer chamber 126 for ejection through port 134.

Chamber 158 can be operated in parallel with the other chambers to increase the force exerted by the power cylinder. For example, when chamber 158 contains pressurized fluid (supplied through port 162) it is able to support a portion of the load which would otherwise be supported only by rods 128, 130. Such added support reduces the likelihood that the rods will be bent by subjecting them to excessive forces. Bent rods cause excessive wearing of the rod seals and bearings. Alternatively, by relying upon the load-supporting capability of the pressurized fluid in chamber 158, one may reduce the size of rods 128, 130 and thus reduce the cost of manufacturing the power cylinder.

Filters 151, 153 incorporate simple spring-loaded check valves which open when cylinder 100 retracts, allowing air to be drawn through each filter. As cylinder 100 extends, the check valves close. This causes clean air to be forced past seals 146, 148 to dislodge dirt or other foreign matter which may tend to accumulate in the vicinity of the seals.

Figure 3:
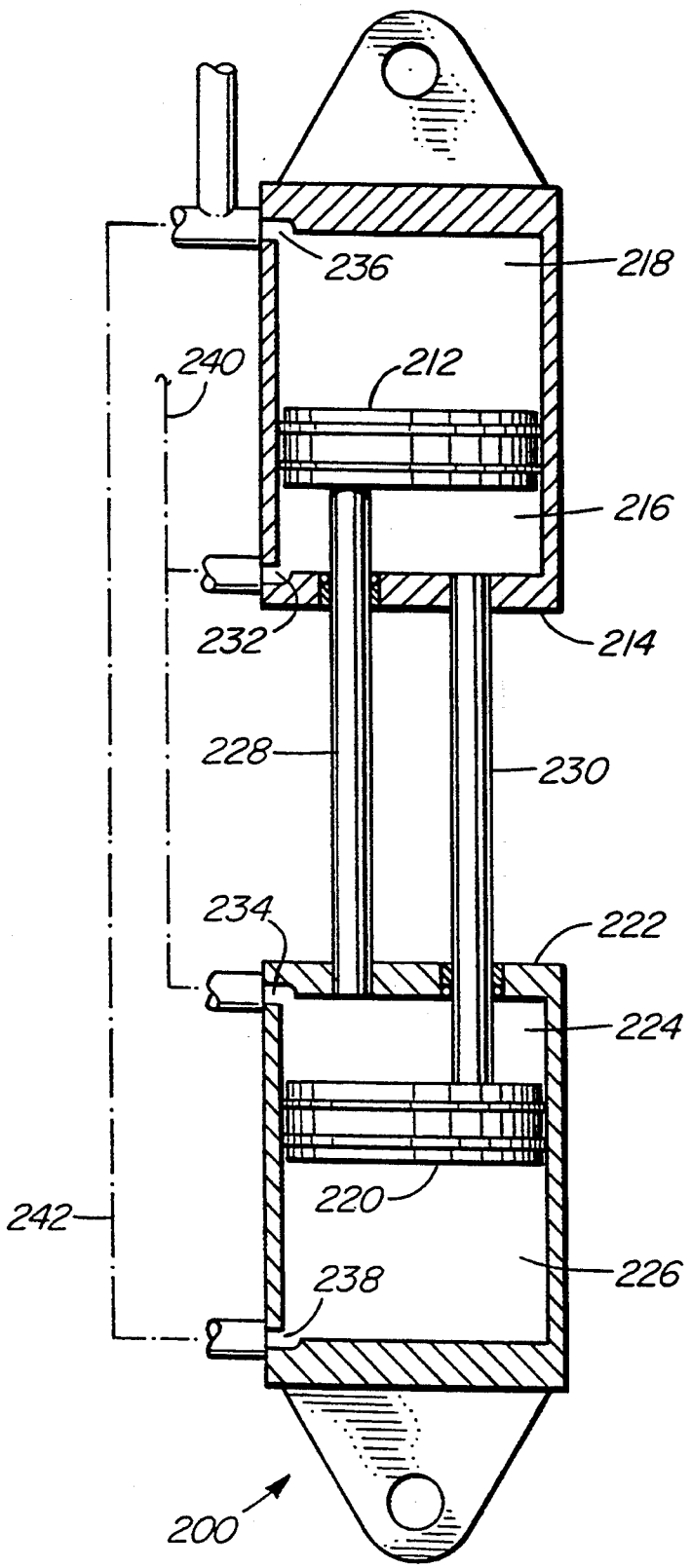
FIG. 3 is a longitudinal cross-sectional illustration of a power cylinder constructed in accordance with the fourth embodiment of the invention.

FIG. 3 illustrates a further alternative power cylinder 200 having a first piston 212 slidably mounted within a first cylinder 214 to define inner and outer chambers 216, 218 within first cylinder 214. A second piston 220 is slidably mounted within a second cylinder 222 to define inner and outer chambers 224, 226 within second cylinder 222. A single rod 228 is coupled between first piston 212 and second cylinder 222. A second rod 230 is coupled between first cylinder 214 and second piston 220.

Fluid flow ports 232, 234, 236, 238 are provided in inner chambers 216, 224 and in outer chambers 218, 226 respectively to allow pressurized hydraulic or pneumatic fluid to flow into or out of the chambers. A "fluid flow means" such as conduit 240 is coupled between inner chamber ports 232, 234. Another "fluid flow means" such as conduit 242 is coupled between outer chamber ports 236, 238. Conventional seals are provided in the apertures of cylinders 214, 222 through which rods 228,230 pass; and, conventional sealing rings are provided around pistons 212, 220.

Cylinder 200 is extended by injecting pressurized hydraulic or pneumatic fluid into conduit 242 while withdrawing fluid from conduit 240. Fluid injected through conduit 242 enters outer chambers 218, 226 and exerts force on the outer faces of pistons 212, 220. Since first piston 212 is connected to second cylinder 222; and first cylinder 214 is connected to second piston 220; cylinders 214, 222 are slidably forced apart. This increases the volume of outer chambers 218, 226 and simultaneously decreases the volume of inner chambers 216, 224.

Cylinder 200 is retracted by injecting pressurized hydraulic or pneumatic fluid into conduit 240 while withdrawing fluid from conduit 242. Fluid injected through conduit 240 enters inner chambers 216, 224 and exerts force on the inner faces of pistons 212,220. Since first piston 212 is connected to second cylinder 222; and first cylinder 214 is connected to second piston 220; cylinders 214, 222 are slidably forced towards one another. This increases the volume of inner chambers 216, 224 and simultaneously decreases the volume of outer chambers 218, 226.

Figure 4:
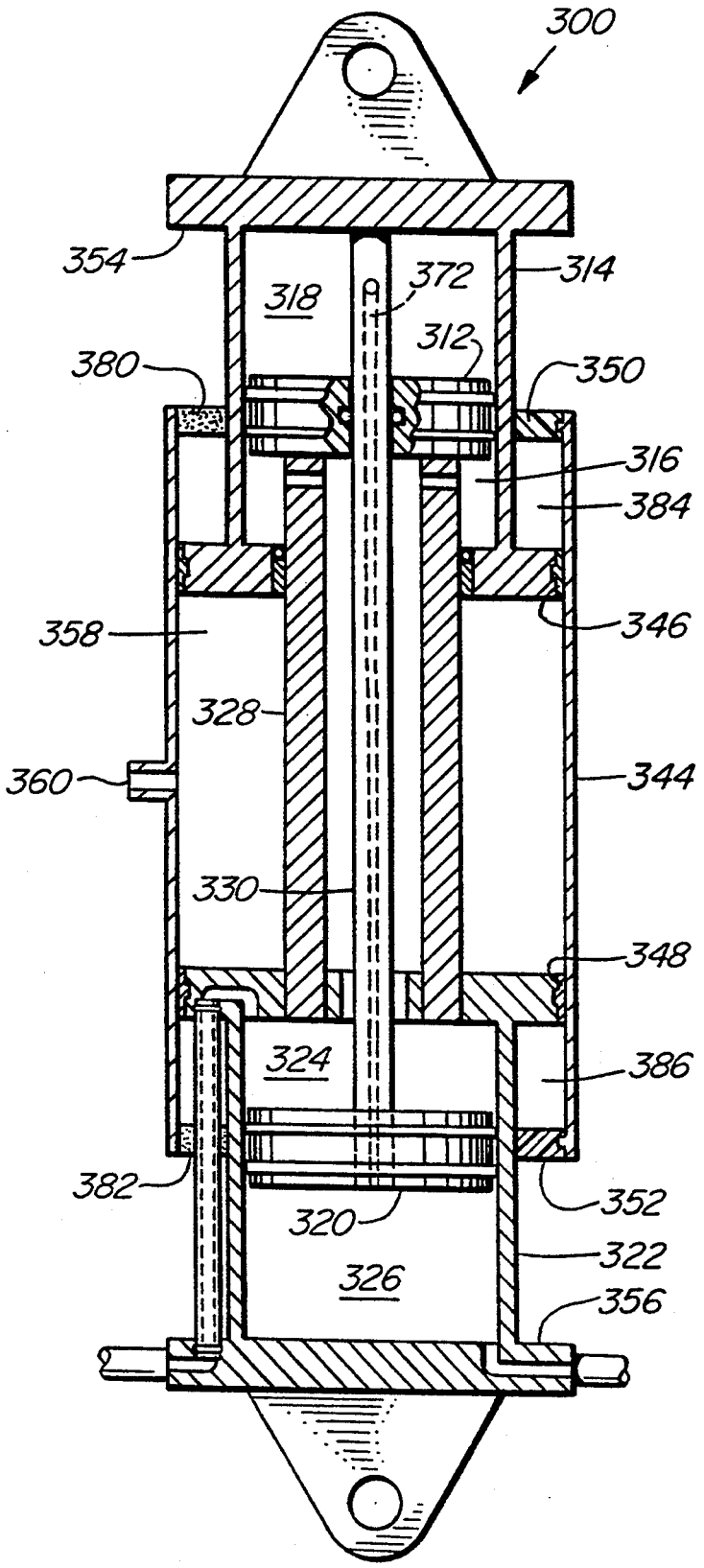
FIG. 4 is a longitudinal cross-sectional illustration of a power cylinder constructed in accordance with the a fifth embodiment of the invention, with an outer guard in place.

FIG. 4 illustrates a further alternative power cylinder 300 which is similar to cylinder 200, except that the first rod 328 is hollow and the second rod 330 is located within the axial bore of the first rod 328; and an outer guard is shown surrounding the cylinders 314, 322 enclosing a hydraulic chamber 358. More particularly, first piston 312 is slidably mounted within a first cylinder 314 to define inner and outer chambers 316, 318 within first cylinder 314. A second piston 320 is slidably mounted within a second cylinder 322 to define inner and outer chambers 324, 326 within second cylinder 322. First hollow rod 328 is coupled between first piston 312 and the proximal end of second cylinder 322. Second rod 330 is coupled between second piston 320 and the distal end of first cylinder 314. Second rod 330 is located within the axial bore of the first rod 328. Outer chambers 318, 326 may be coupled together to allow pressurized hydraulic or pneumatic fluid to flow freely between the outer chambers through a passage 372 in rod 330; and, inner chambers 316, 324 may be coupled together to allow pressurized hydraulic or pneumatic fluid to flow freely between the inner chambers through a passage 374 in rod 328.

FIG. 4 also illustrates the provision of a cylindrical outer guard 344 on power cylinder 300. Guard 344 serves the same purpose as guard 144 depicted in FIG. 2. More particularly, guard 344 surrounds first and second cylinders 314, 322. Seals 346, 348 are fixed around the opposed inner ends of cylinders 314, 322 to provide a hydraulic chamber 358 enclosed by the guard 344 between the cylinders 314, 322. Bearings 350, 352 fixed around the opposed ends of guard 344 allow slidable displacement of the cylinders relative to guard 344. Stops 354, 356 fixed around the outer ends of cylinders 314, 322 prevent inadvertent dislodgment of guard 344 from around cylinders 314, 322. Hydraulic chamber 358 enclosed by guard 344, cylinders 314, 322 and seals 346, 348 is extended (or retracted) by injecting (or withdrawing) pressurized hydraulic or pneumatic fluid from port 360. Filters 380, 382 prevent foreign matter from penetrating into regions 384, 386. Foreign matter entering region 384 or 386 may nick or abrade seals 346, 348.

Figure 5:
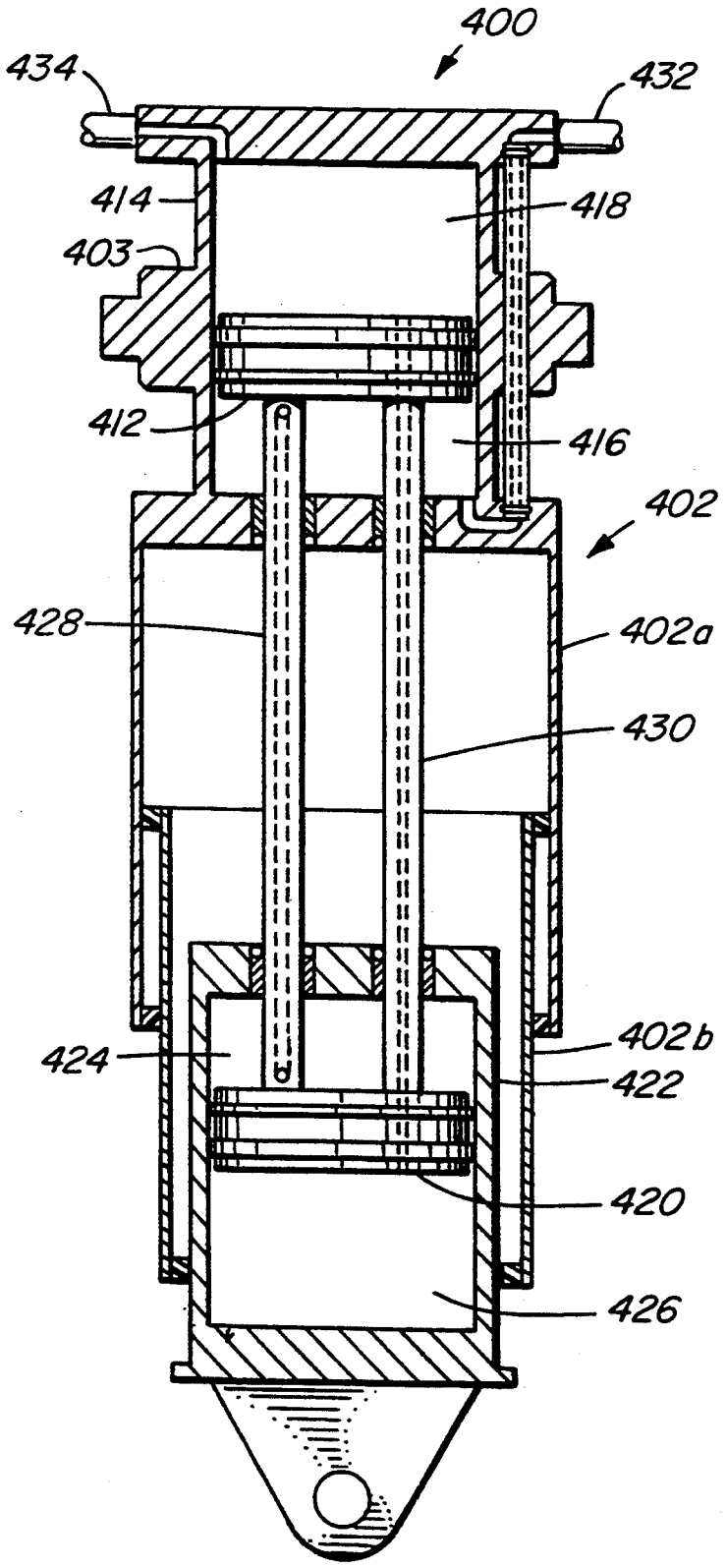
FIG. 5 shows how the invention can be adapted for use with a trunnion mount.

FIG. 5 shows how the invention can be adapted for use with a trunnion mount whilst retaining the advantages of a guard. Specifically, FIG. 5 illustrates an alternative power cylinder 400 which is functionally similar to the FIG. 2 embodiment, except that guard 402 comprises upper and lower halves **402*a*, 402*b* which slide relative to one another. Unlike the FIG. 2 embodiment, no attempt is made to confine hydraulic or pneumatic fluid within guard 402 of the FIG. 5 embodiment. Otherwise, the FIG. 2 and 5 embodiments are similar: first piston 412 slidably mounted within first cylinder 414 defines inner and outer chambers 416, 418 within first cylinder 414. Second piston 420 slidably mounted within second cylinder 422 defines inner and outer chambers 424, 426 within second cylinder 422. Hollow rods 428, 430 are coupled between first and second pistons 412, 420** thereby fixing the displacement between the two pistons.

FIG. 5 shows power cylinder 400 with upper cylinder 414 rotated 90° to better illustrate trunnion mount 403. The upper end of upper guard **402*a* is fixed around the lower end of first cylinder 414, leaving room for direct affixation of trunnion mount 403 to first cylinder 414. The lower end of lower guard 402*b* is fixed around the lower end of second cylinder 422. The circumference of upper guard 402*a* is slightly greater than that of lower guard 402*b*, allowing the two halves to telescope relative to one another, as shown. Suitable bearings are provided around the lower end of upper guard 402*a* and around the upper end of lower guard 402***b* to allow slidable displacement of the guard halves relative to one another.

Cylinder 400 is extended by injecting pressurized hydraulic or pneumatic fluid into port 434 while withdrawing fluid through port 432. Fluid injected through port 434 enters outer chamber 418 and passes through hollow rod 430 into outer chamber 426, exerting force on pistons 412, 420 and forcing cylinders 414, 422 apart. As the cylinders are forced apart, they draw the respective guard halves with them (i.e. the lower end of upper guard 402*a* is slidably drawn upwardly over the outer surface of lower guard 402*b*, and the upper end of lower guard 402*b* is slidably drawn downwardly over the inner surface of upper guard 402*a*). The guard halves thus maintain enclosure of internal region 458, preventing foreign matter from reaching the exposed outer surface of rods 428, 430.

Those skilled in the art will understand that the embodiments herein disclosed provide a number of advantages over the prior art. Because two separate cylinders are independently displaced, for a given length of extension, each seal is exposed to only about half the distance of travel that would be experienced in conventional cylinders. This reduces wear on each seal and bearing by distributing the wearing forces over two sets of seals and bearings, as compared with only one set in a conventional single rod cylinder.

A further advantage is that the ends of cylinders constructed in accordance with either embodiment of the invention are identical, facilitating affixation of identical coupling eyes to both cylinder ends without regard to the diameter of the cylinder rods. Conventional cylinders often require larger diameter rods to accommodate larger coupling eyes, which affects the size, cost and force capacity of the cylinder. Because there is no connection between the rod ends and the coupling eyes, the diameter of the rods may be selected with reference to the loads to be borne by the cylinder, and without regard to the size of the coupling eyes. In a conventional cylinder, the coupling eyes may have to be enlarged to accommodate the load support bearings fitted within the eyes. If the size of the coupling eyes is increased, then the diameter of the rods must be correspondingly increased to support the larger eyes. But, if the rod diameter increases then the effective piston area decreases on the rod side of the piston, which in turn reduces the power which may be exerted as the rod is retracted within the cylinder. These problems are avoided by the present invention.

Power cylinders constructed in accordance with the invention are capable of exerting greater force than conventional cylinders of the same diameter having rods of the same diameter. For example, cylinder 10 (FIG. 1) can exert about twice the force of a conventional cylinder with the same cylinder and rod diameters. This is because central chamber 58 can be operated in parallel with the two pairs of inner/outer chambers 16,18/24,26 to increase the force exerted by cylinder 10. When chamber 58 contains pressurized fluid (supplied through port 162) it is able to support a portion of the load which would otherwise be supported only by rod 28. A similar doubling of output force can be achieved with cylinder 100 shown in FIG. 2. Cylinder 200 (FIG. 3) also achieves doubled force output, relative to a conventional cylinder with the same cylinder and rod diameters, but in this case the force doubling is due to the parallel effect caused by the fixation of the ends of rods 228,230 to the opposed cylinders, rather than to the opposed pistons. Cylinder 300 (FIG. 4) achieves trebled force output by combining both of the foregoing features (i.e. fixation of the rods to the opposed cylinders; and, pressurization of central chamber 358 in addition to the twin pairs of inner/outer chambers).

As will be apparent to those skilled in the art in the light of the foregoing disclosure, many alterations and modifications are possible in the practice of this invention without departing from the spirit or scope thereof. For example, the dual pistons employed in hydraulic cylinders constructed in accordance with the invention need not be of the same size. If pistons of different sizes are employed, the speed and available power of the cylinder can be controlled using a simple hydraulic circuit. Accordingly, the scope of the invention is to be construed in accordance with the substance defined by the following claims.

What is claimed is:

1. A power cylinder (10) having a first piston (12) slidably mounted within a first cylinder (14) to define inner and outer chambers (16, 18) within said first cylinder, a second piston (20) slidably mounted within a second cylinder (22) to define inner and outer chambers (24, 26) within said second cylinder and at least one rod (28) coupled between said first and second pistons, characterized by:

(a) first fluid flow means (40) coupled to said first and second cylinder inner chambers;

(b) second fluid flow means (42) coupled to said first and second cylinder outer chambers.

(c) a cylindrical guard (44) surrounding said first and second cylinders; and, (d) bearing means for allowing slidable displacement of said first and second cylinders relative to said guard.

2. A power cylinder as defined in claim 1, further comprising:

(a) sealing means (46, 48; 146, 148) between said guard and said first and second cylinders for hydraulically isolating a chamber (58; 158) between said guard and said first and second cylinders; and, (b) a fluid flow port (162) in said guard for fluid flow to and from said isolated chamber.

3. A power cylinder as defined in claim 3, further comprising filtration means (151, 153) for preventing foreign matter penetration between said guard and said first or second cylinders.

4. A power cylinder (100) having a first piston (112) slidably mounted within a first cylinder (114) to define inner and outer chambers (116, 118) within said first cylinder, a second piston (120) slidably mounted within a second cylinder (122) to define inner and outer chambers (124, 126) within said second cylinder, characterized by:

(a) a first hollow rod (130) coupled between said first and second pistons for fluid flow through said first rod between said first and second outer chambers;

(b) a second hollow rod (128) coupled between said first and second pistons for fluid flow through said second rod between said first and second inner chambers;

(c) a first fluid flow port (134) in one of said outer chambers;

(d) a second fluid flow port (132) in one of said inner chambers; and, (e) a cylindrical guard (144) surrounding said first and second cylinders.

5. A power cylinder as defined in claim 4, further comprising:

(a) sealing means (46, 48; 146, 148) between said guard and said first and second cylinders for hydraulically isolating a chamber (58; 158) between said guard and said first and second cylinders; and, (b) a third fluid flow port (162) in said guard for fluid flow to and from said isolated chamber.

6. A power cylinder as defined in claim 5, further comprising filtration means (151, 153) for preventing foreign matter penetration between said guard and said first or second cylinders.

7. A power cylinder (200) having a first piston (212) slidably mounted within a first cylinder (214) to define inner and outer chambers (216, 218) within said first cylinder, and a second piston (220) slidably mounted within a second cylinder (222) to define inner and outer chambers (224, 226) within said second cylinder, characterized by:

(a) a first rod (228) coupled between said first piston and said second cylinder;

(b) a second rod (230) coupled between said second piston and said first cylinder;

(c) first fluid flow means (240) coupled to said first and second cylinder inner chambers; and, (d) second fluid flow means (242) coupled to said first and second cylinder outer chambers.

8. A power cylinder (300) having a first piston (312) slidably mounted within a first cylinder (314) to define inner and outer chambers (316, 318) within said first cylinder, and a second piston (320) slidably mounted within a second cylinder (322) to define inner and outer chambers (324, 326) within said second cylinder, characterized by:

(a) a first-rod (328) coupled between said first piston and said second cylinder; and, (b) a second rod (330) coupled through said first rod between said second piston and said first cylinder.

9. A power cylinder as defined in claim 8, further comprising:

(a) a cylindrical guard (344) surrounding said first and second cylinders; and, (b) bearing means (350, 352) for allowing slidable displacement of said first and second cylinders relative to said guard.

10. A power cylinder as defined in claim 9, further comprising:

(a) sealing means (346, 348) between said guard and said first and second cylinders for hydraulically isolating a chamber (358) between said guard and said first and second cylinders; and, (b) a fluid flow port (360) in said guard for fluid flow to and from said isolated chamber.

11. A power cylinder as defined in claim 10, further comprising filtration means (151, 153) for preventing foreign matter penetration between said guard and said first or second cylinders.

12. A power cylinder (400) having a first piston (412) slidably mounted within a first cylinder (414) to define inner and outer chambers (416, 418) within said first cylinder, a second piston (420) slidably mounted within a second cylinder (422) to define inner and outer chambers (424, 426) within said second cylinder, characterized by:

(a) a first hollow rod (430) coupled between said first and second pistons for fluid flow through said first and second pistons for fluid flow through said first rod between said first and second outer chambers;

(b) a second hollow rod (428) coupled between said first and second pistons for fluid flow through said second rod between said first and second inner chambers;

(c) a first fluid flow port (434) in one of said outer chambers;

(d) a second fluid flow port (432) in one of said inner chambers;

(e) an upper cylindrical guard (402*a*) having one end fixed around a lower end of said first cylinder; and, (f) a lower cylindrical guard (402*b*) having one end fixed around an upper end of said second cylinder;

wherein opposed ends of said upper and lower guards slide over one another during extension or retraction of said power cylinder, enclosing said rods.

* * * * *